US010787791B2

(12) United States Patent
Jung et al.

(10) Patent No.: US 10,787,791 B2
(45) Date of Patent: Sep. 29, 2020

(54) DRIVE CONTROL METHOD OF HYDRAULIC ACTUATOR OF CONSTRUCTION MACHINE

(71) Applicant: VOLVO CONSTRUCTION EQUIPMENT AB, Eskilstuna (SE)

(72) Inventors: Tae-Rang Jung, Gyeongsangnam-do (KR); Chun-Han Lee, Gyeongsangnam-do (KR)

(73) Assignee: Volvo Construction Equipment AB, Eskilstuna (SE)

( * ) Notice: Subject to any disclaimer, the term of this patent is extended or adjusted under 35 U.S.C. 154(b) by 390 days.

(21) Appl. No.: 15/542,018

(22) PCT Filed: Jan. 8, 2015

(86) PCT No.: PCT/KR2015/000180

§ 371 (c)(1),
(2) Date: Jul. 6, 2017

(87) PCT Pub. No.: WO2016/111393

PCT Pub. Date: Jul. 14, 2016

(65) Prior Publication Data

US 2018/0002896 A1 Jan. 4, 2018

(51) Int. Cl.
*E02F 9/22* (2006.01)
*E02F 9/20* (2006.01)
(Continued)

(52) U.S. Cl.
CPC ..... *E02F 9/2228* (2013.01); *E02F 9/123* (2013.01); *E02F 9/2004* (2013.01);
(Continued)

(58) Field of Classification Search
None
See application file for complete search history.

(56) References Cited

U.S. PATENT DOCUMENTS 4,034,563 A 7/1977 Orth
5,442,912 A 8/1995 Hirata et al.
(Continued)

FOREIGN PATENT DOCUMENTS

CA 2889909 A1 5/2014
CN 102116040 A 7/2011
(Continued)

OTHER PUBLICATIONS

European Search Report (dated Nov. 20, 2018) for corresponding European App. EP 15 87 7114.
(Continued)

*Primary Examiner* — Thomas G Black
*Assistant Examiner* — Demetra R Smith-Stewart
(74) *Attorney, Agent, or Firm* — Sage Patent Group

(57) ABSTRACT

A drive control method of a hydraulic actuator of a construction machine includes: determining whether a rotation operation lever and a working device operation lever are operated; calculating the required pressure of a hydraulic cylinder fix a working device according to the operation amount of the rotation operation lever; calculating the required flow rates of a swing motor and the hydraulic cylinder for the working device, the required flow rates corresponding to the operation amounts of the working device operation lever and the rotation operation lever; calculating the opening areas of the first and second proportional solenoid valves of an inlet side and an outlet side by using the calculated required pressure and required flow rates of the hydraulic cylinder for the working device and the swing motor; and calculating current values to be inputted into the first and second proportional solenoid valves of the inlet side and the outlet side according to preset data values or a table in comparison with the calculated opening areas of the first and second proportional solenoid valves of the inlet side and the outlet side.

4 Claims, 3 Drawing Sheets

(51) Int. Cl.

| | |
|---|---|
| ***E02F 9/12*** | (2006.01) |
| ***F15B 13/04*** | (2006.01) |
| ***F15B 21/08*** | (2006.01) |
| ***F15B 11/00*** | (2006.01) |

(52) U.S. Cl.

CPC ..... *E02F 9/2267* (2013.01); *E02F 9/2271* (2013.01); *E02F 9/2296* (2013.01); *F15B 11/006* (2013.01); *F15B 13/04* (2013.01); *F15B 21/082* (2013.01); *F15B 21/087* (2013.01); *F15B 2211/20546* (2013.01); *F15B 2211/30575* (2013.01); *F15B 2211/6346* (2013.01); *F15B 2211/6658* (2013.01); *F15B 2211/7053* (2013.01); *F15B 2211/7058* (2013.01); *F15B 2211/7135* (2013.01); *F15B 2211/781* (2013.01)

(56) References Cited

U.S. PATENT DOCUMENTS

| | | | | |
|---|---|---|---|---|
| 5,813,311 | A | 9/1998 | Toyooka et al. | |
| 2006/0130473 | A1* | 6/2006 | Kim | E02F 9/2282 60/430 |
| 2013/0291530 | A1 | 11/2013 | Bang et al. | |
| 2014/0052350 | A1* | 2/2014 | Tsuruga | E02F 3/325 701/50 |
| 2015/0144408 | A1* | 5/2015 | Ishihara | E02F 9/2075 180/53.4 |
| 2017/0009424 | A1* | 1/2017 | Moriki | E02F 3/422 |

FOREIGN PATENT DOCUMENTS

| | | | |
|---|---|---|---|
| CN | 203717513 | A | 7/2014 |
| KR | 1020140037007 | A | 3/2014 |
| KR | 20140080177 | A | 6/2014 |
| KR | 1020140050009 | A | 9/2014 |
| KR | 1020140136083 | A | 11/2014 |
| WO | 2013115986 | A1 | 8/2013 |

OTHER PUBLICATIONS

Chinese Official Action (dated Sep. 25, 2018) for corresponding Chinese App. 20150072708.0.

International Search Report (dated Sep. 24, 2015) for corresponding International App. Tae-Rang Jung.

* cited by examiner

[Fig. 1]
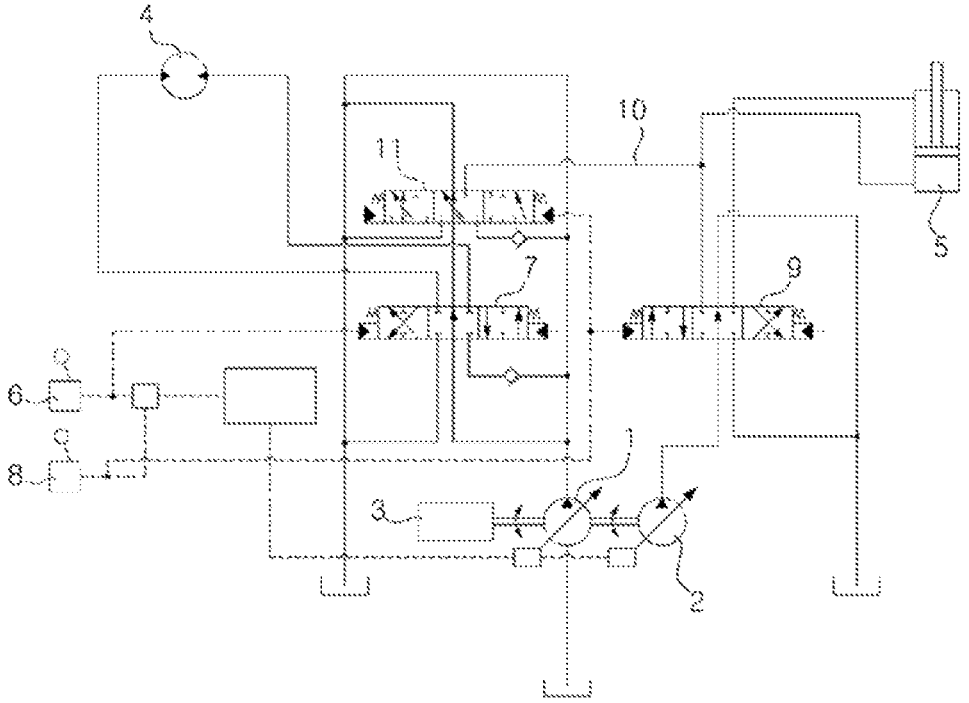
[Fig. 2]
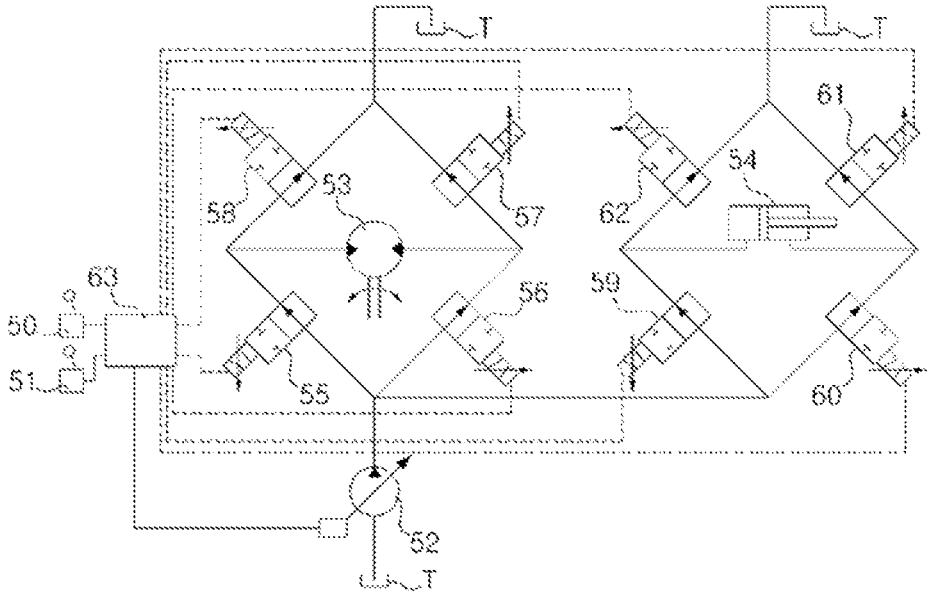

[Fig. 3]
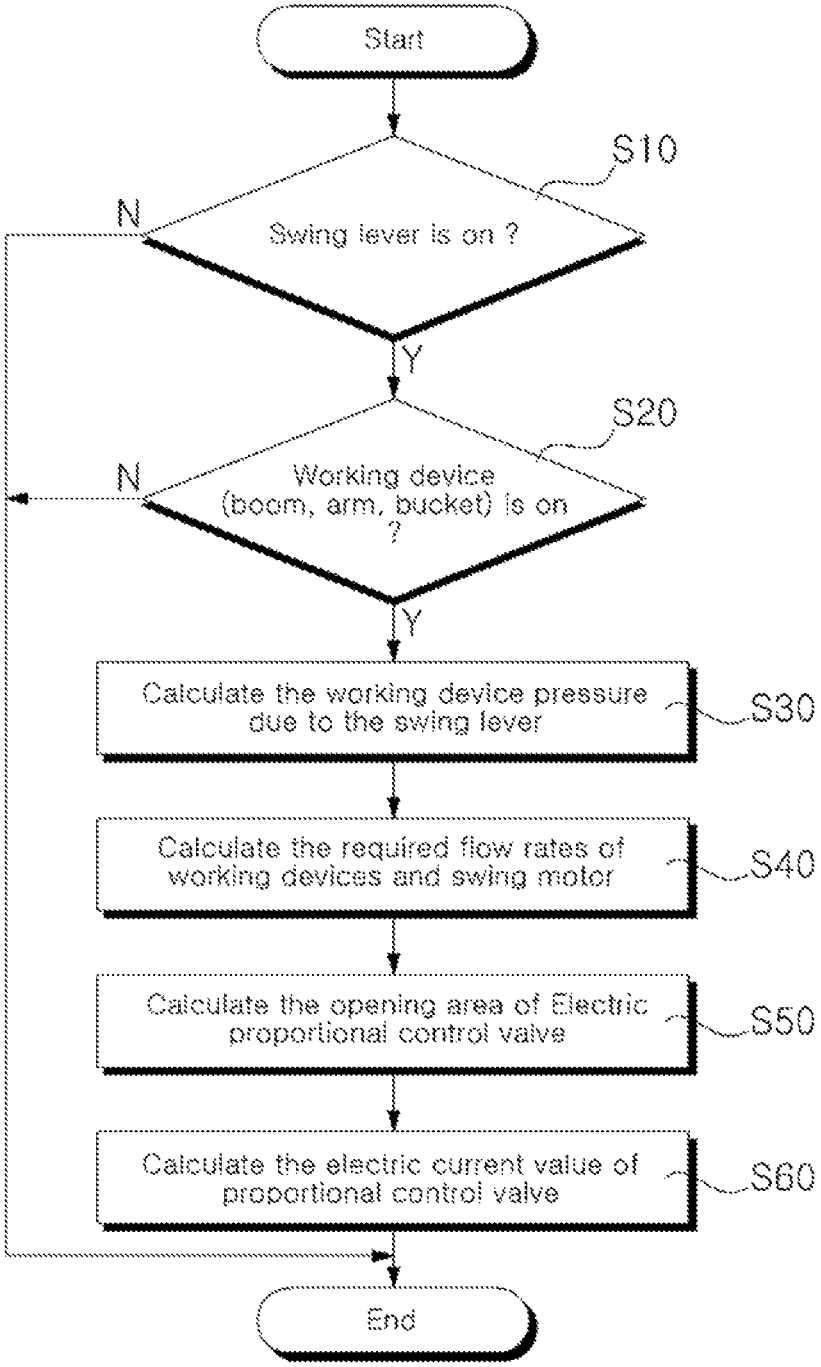

[Fig. 4]
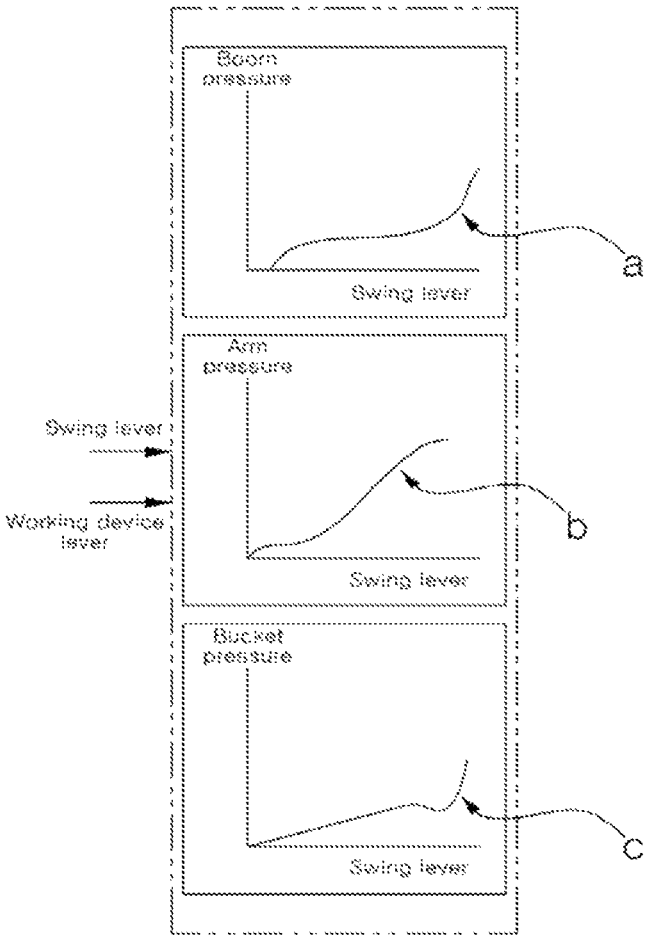
[Fig. 5]
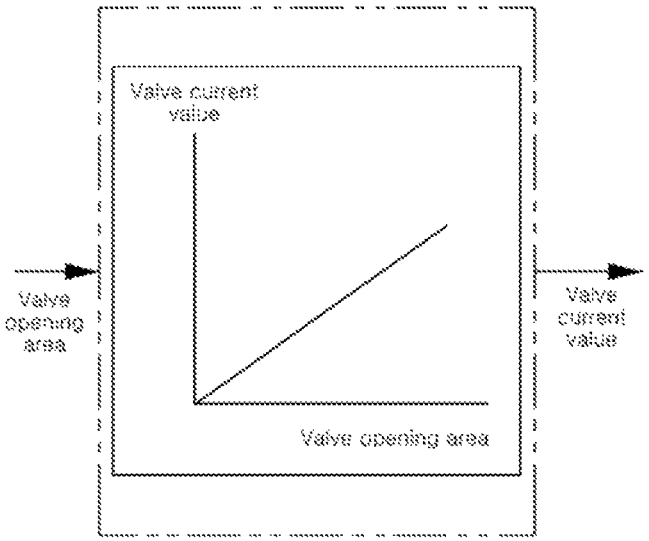

DRIVE CONTROL METHOD OF HYDRAULIC ACTUATOR OF CONSTRUCTION MACHINE

BACKGROUND AND SUMMARY

The present invention relates to a drive control method of hydraulic actuator of construction machine and more particularly, a drive control method of hydraulic actuator for construction machine, in which an upper swing body and a working device are in combined operations.

FIG. 1 is a hydraulic circuit illustrating the combined operations of an upper swing body and a working device by driving the swing motor and the hydraulic cylinder for the working device, respectively, according to the conventional technology.

As shown in FIG. 1, first and second variable displacement hydraulic pumps (hereinafter, "first and second hydraulic pumps") (1, 2) are connected to an engine (3).

A swing motor (4) is connected to the first hydraulic pump (1), which rotates the upper swing body by the operating oil of the first hydraulic pump (1).

The hydraulic cylinder for the working device (hereinafter, "hydraulic cylinder") (5) is connected to the second hydraulic pump (2) and is driven by the operating oil of the second hydraulic pump (2).

A swing control valve (7) is installed in the flow path between the first hydraulic pump (1) and the swing motor (4), which controls the supply of operating oil to the swing motor by shifting as the pilot pressure is applied by the swing operation lever (6).

The working device control valve (9) is installed in the path between the second hydraulic pump (2) and the hydraulic cylinder (5), which controls the supply of operating oil to the hydraulic cylinder by shifting as the pilot pressure is applied by the working device operation lever (8).

A confluence control valve (11) is installed at the downstream side of the swing control valve (7) in the flow path of the first hydraulic pump (1), by which some of the operating oil supplied to the swing motor (4) from the first hydraulic pump (1) is joined to the hydraulic cylinder (5) through the path (10) during the combined operations by operating of the swing operation lever (6) and the working device operation lever (8).

In order to decide the driving priority between the swing motor (4) and the hydraulic cylinder (5) according to the work environments or the driver's demand, additional valve arrangements (for example, orifice) are installed in the flow path between the first hydraulic pump (1) and the swing control valve (7), or in the flow path between the second hydraulic pump (2) and the working device control valve (9).

As described above, if the additional valve arrangements are installed to distribute the flow rates supplied to the swing motor (4) and the hydraulic cylinder (5), it not only causes the pressure loss due to the resistance of the hydraulic hoses piping lines, but results fixing the driving priority that has been already decided between the swing motor (4) and the hydraulic cylinder (5).

Accordingly, it is desirable to provide a drive control method of hydraulic actuator for construction machine, which allows the driving priority to be changed freely in the combined operations of the swing motor for rotating the upper swing body and the hydraulic cylinder for operating, the working device.

In accordance with an embodiment of the present invention, there is provided a drive control method of hydraulic actuator for construction machine, including an electronic swing operation lever; an electronic working device operation lever; a variable displacement hydraulic pump; a swing motor and a hydraulic cylinder that is driven by hydraulic fluid of the hydraulic pump; first electric proportional control valves at an inlet line and an outlet line of the swing motor for supplying and discharging the hydraulic fluid of the hydraulic pump, respectively; second electric proportional control valves at an inlet line and an outlet line of the hydraulic cylinder for supplying and discharging the hydraulic fluid of the hydraulic pump, respectively; and a controller to which operation signals are inputted by operating the swing operation lever and the working device operation lever, the method comprising;

a step of judging whether or not the swing operation lever and the working device operation lever are in combined operations;

a step of calculating a required pressure of the hydraulic cylinder corresponding to the operation amount of the swing operation lever;

a step of calculating a required flow rate of the hydraulic cylinder corresponding to the operation amount of the working device operation lever, and a required flow rate of the swing motor corresponding to the operation amount of the swing operation lever;

a step of calculating valve opening areas of the first and second electric proportional control valves at the inlet and outlet lines of the hydraulic cylinder or the swing motor using the required pressure and flow rate of the hydraulic cylinder and the swing motor, respectively; and, a step of calculating electric current values inputted to the first and second proportional control valves at the inlet and outlet lines by comparing the valve opening areas of the first and second electric proportional control valves at the inlet and outlet lines with the predetermined data or a value of data table, respectively.

In accordance with an embodiment of the present invention, the hydraulic cylinder for working device is one of boom cylinder, arm cylinder and bucket cylinder.

Further, the electric current values inputted to the first and second electric proportional control valves at the inlet and outlet lines are obtained from a predetermined data of a table, which are directly proportional to the valve opening areas of the first and second electric proportional control valves at the inlet and outlet lines.

The valve opening areas are given as follows;

the valve opening area of the first electric proportional control valve at the inlet of the swing motor=the required flow rate of swing motor/square root of the required pressure of swing motor;

the valve opening area of the first electric proportional control valve at the outlet of the swing motor=the required flow rate of swing motor/square root of [the required pressure of swing motor−the hydraulic fluid pressure drained from the swing motor];

the valve opening area of the second electric proportional control valve at the inlet of the hydraulic cylinder for the working device=the required flow rate of hydraulic cylinder for the working device/square root of the required pressure of hydraulic cylinder for the working device; and the valve opening area of the second electric proportional control valve at the outlet of the hydraulic cylinder for the working device=the required flow rate of hydraulic cylinder for the working device/square root of [the required pressure of hydraulic cylinder for the working device−the hydraulic fluid pressure drained from the hydraulic cylinder].

The required pressure of the hydraulic cylinder corresponding to the operation amount of the swing operation lever is obtained from the table comparing boom pressure, arm pressure, and bucket pressure with the operation amount of the swing operation lever, respectively.

According to the embodiment of the present invention having the above-described configuration, the priority in driving the upper swing body and the working device such as boom can be changed without restriction by the independently controlled electric proportional control valves, and thus the working efficiency can be greatly improved.

BRIEF DESCRIPTION OF THE DRAWINGS

The above features and advantages of the present invention will become more apparent by describing the preferred embodiments thereof with reference to the accompanying drawings, in which:

FIG. 1 is a hydraulic circuit illustrating the combined operations of an upper swing body and a working device by driving a swing motor and a hydraulic cylinder for the working device, respectively, according to the conventional technology.

FIG. 2 is a hydraulic circuit used in a method for driving hydraulic actuator for construction machine according to the preferred embodiment of the present invention.

FIG. 3 is a flow chart showing a control method for driving a hydraulic actuator for construction machine according to the preferred embodiment of the present invention FIG. 4 is a graph showing the relationship between a pressure of working device and an operation amount of swing operation lever in a control method for driving a hydraulic actuator for construction machine according to the preferred embodiment of the present invention.

FIG. 5 is a graph showing the relationship between the valve opening area of the electric proportional control valve and die electric current value inputted to the electric proportional control valve in a control method for driving a hydraulic actuator for the construction machine according to the preferred embodiment of the present invention.

EXPLANATION OF REFERENCE NUMERALS FOR MAIN PARTS IN THE DRAWING

50; swing operation lever (RCV)
51; working device operation lever (RCV)
52; variable displacement hydraulic pump
53; swing motor
54; hydraulic cylinder
55, 56; first electric proportional control valve at the inlet
57, 58; first electric proportional control valve at the outlet
59, 60; second electric proportional control valve at the inlet
61, 62; second electric proportional control valve at the outlet

DETAILED DESCRIPTION

Hereinafter, a chive control method of hydraulic actuator for construction machine according to a preferred embodiment of the present invention will be described in detail with reference to the accompanying drawings.

FIG. 2 is a hydraulic circuit used in a method for driving hydraulic actuator for construction machine according to the preferred embodiment of the present invention. FIG. 3 is a flow chart showing a control method for driving hydraulic actuator for construction machine according to the preferred embodiment of the present invention. FIG. 4 is a graph showing the relationship between the pressure of working device and the operation amount of swing operation lever in the control method for driving the hydraulic actuator for construction machine according to the preferred embodiment of the present invention. FIG. 5 is a graph showing the relationship between the valve opening area of the electric proportional control valve and the electric current value inputted to the electric proportional control valve in the control method for driving the hydraulic actuator for construction machine according to the preferred embodiment of the present invention.

Referring FIGS. 2 to 5, the drive control method of the hydraulic actuator for construction machine, an electronic swing operation lever (50); an electronic working device operation lever (51); a variable displacement hydraulic pump (52); a swing motor (53) and a hydraulic cylinder (54) that is driven by hydraulic fluid of the hydraulic pump (52); first electric proportional control valves (55, 56) at an inlet line and an outlet line of the swing motor (53) for supplying and discharging the hydraulic fluid of the hydraulic pump (52), respectively; second electric proportional control valves (59, 60) at an inlet line and an outlet line of the hydraulic cylinder (54) for supplying and discharging the hydraulic fluid of the hydraulic pump (52), respectively; and a controller (ECU, 63) to which operation signals are inputted by operating the swing operation lever (50) and the working device operation lever (51), the method comprises;

a step (S10, S20) of judging whether or not the swing operation lever (50) and the working device operation lever (51) are in combined operations;

a step (S30) of calculating a required pressure of the hydraulic cylinder corresponding to the operation amount of the swing operation lever (50);

a step (S40) of calculating a required flow rate of the hydraulic cylinder corresponding to the operation amount of the working device operation lever (51) (which is the maximum flow rate of hydraulic cylinder (54) multiplied h the operation ratio of working device op ration lever (51)), and a required flow rate of the swing motor (53) corresponding to the operation amount of the swing operation lever (50) (which is given by the maximum flow rate of swing motor (53) multiplied by the operation ratio of swing operation lever (50));

a step (S50) of calculating valve opening areas of the first and second electric proportional control valves at the inlet and outlet lines of the hydraulic cylinder (54) and the swing motor (53) using the required pressure and the required flow rate of the hydraulic cylinder (54) and the swing motor (53), respectively; and, a step (S60) of obtaining or calculating electric current values inputted to the first and second proportional control valves (55, 56, 57, 58, 59, 60, 61, 62) at the inlet and outlet by comparing the opening areas of the first and second proportional control valves at the inlet and outlet lines with a predetermined data or a value of data table, respectively.

The hydraulic cylinder for working device may be one of boom cylinder, arm cylinder and bucket cylinder.

According to the configuration described above, when the swing operation lever (50) is activated, the inlet of the first electric proportional control valve (55) for the swing motor is shifted by the electric signal applied from the controller (63). This takes place with the inlet opening part of the first electric proportional control valve (56) blocked.

Thus, the swing motor (53) is driven by the hydraulic fluid supplied through the inlet of the first electric proportional control valve (55) from the hydraulic pump (52), and the upper swing body is rotated clockwise.

At this moment, the hydraulic fluid discharged from the swing motor (5) is drained to the hydraulic fluid tank (T) through the outlet of the first electric proportional control valve (57) with the outlet opening part of the first electric proportional control valve (58) blocked.

On the other hand, when the working device operation lever (51) is activated, the inlet of the second electric proportional control valve (59) for the working device is shifted by the electric signal applied from the controller (63) with the inlet opening part of the second electric proportional control valve (60) blocked.

Thus, the hydraulic cylinder for the working device is driven by the hydraulic fluid supplied thru the inlet of the second electric proportional control valve (59) from the hydraulic pump (52) which results in the boom up operation.

At this moment, the hydraulic fluid discharged from the hydraulic cylinder (54) is drained to the hydraulic fluid tank (T) through the outlet of the second electric proportional control valve (61) with the outlet opening part of the second electric proportional control valve (62) blocked.

In the combined operations of die swing operation lever (50) and the working device operation lever (51), the priority of driving the swing motor (53) and the hydraulic cylinder (54) is determined depending on the working condition or the driver's request.

As in S10, whether or not the swing operation lever (50) is in operation is judged as the electric signal corresponding to the operation amount of the swing operation lever (50) is inputted to the controller (63). If the swing operation lever (50) is operated, it proceeds to S20, and if not, it ends.

As in S20, whether or not the working device operation lever (51) is under operation is judged as the electric signal corresponding to the operation amount of the working device operation lever (51) is inputted to the controller (63). If the working device operation lever (51) is operated, it proceeds to S30, and if not, it ends.

As in S30, a required pressure of the hydraulic cylinder (54) corresponding to the operation amount of the swine operation lever (50) is calculated.

As shown in FIG. 4, the required pressure of the hydraulic cylinder (54) corresponding to the operation amount of the swing operation lever (50) can be calculated by the graphs (a, b, c) representing the boom pressure, arm pressure, and bucket pressure versus the operation amount of the swing operation lever (50), respectively. The driving priority of the working devices is determined by the values represented by the graphs.

As in S40, a required flow rate of the hydraulic cylinder corresponding to the operation amount of the working device operation lever (51) is calculated as the maximum flow rate of hydraulic cylinder (54) multiplied by the operation ratio of working device operation lever (51), and the required flow raw of the swing motor (53) corresponding to the operation amount of the swing operation lever (50) is calculated as the maximum flow rate of swing motor (53) multiplied by the operation ratio of swing operation lever (50).

As in S50, the valve opening areas of the first and second electric proportional control valves (55, 56, 57, 58, 59, 60, 61, 62) at the inlet and outlet of the hydraulic cylinder (54) and the swing motor (53) are calculated using the required pressure and the required flow rate of the hydraulic cylinder (54) and the swing motor (53).

The opening area of the first proportional control valve (55, 56) at the inlet of the swing motor (53)=the required flow rate of swing motor (53)/square root of the required pressure of swing motor (53).

The opening area of the first electric proportional control valve (57, 58) at the outlet of the swing motor=the required flow rate of swing motor (53)/square root of [the required pressure of swing motor−the hydraulic fluid pressure drained from the swing motor to the hydraulic fluid tank (T)].

The opening area of the second electric proportional control valve (59, 60) at the inlet of the hydraulic cylinder=the required flow rate of hydraulic cylinder (54)/square root of the required pressure of hydraulic cylinder.

The opening area of the second electric proportional control valve (61, 62) at the outlet of the hydraulic cylinder=the required flow rate of hydraulic cylinder (54)/square root of [the required pressure of hydraulic cylinder−the hydraulic fluid pressure drained from the hydraulic cylinder to the hydraulic fluid tank (T)].

As in S60, the electric current values inputted to the first and second proportional control valves (55, 56, 57, 58, 59, 60, 61, 62) at the inlet and outlet are obtained by comparing the valve opening areas of the first and second electric proportional control valves at the inlet and outlet with a predetermined data or a value of table.

The electric current values inputted to the first and second electric proportional control valves (55, 56, 57, 58, 59, 60, 61, 62) at the inlet and outlet of the swing motor (53) and the hydraulic cylinder (54) for the working device can be drawn from the predetermined data which are directly proportional to the valve opening areas of the first and second electric proportional control valves (55, 56, 57, 58, 59, 60, 61, 62) at the inlet and outlet.

According to the embodiment of the present invention as described above, when the electric swing operation lever (50) and the working device operation lever (51) are operated together, the hydraulic fluids supplied from the hydraulic pump (52) to the swing motor (53) and the hydraulic cylinder for the working device are controlled by the first and second electric proportional control valves (55, 56, 57, 58, 59, 60, 61, 62) at the inlet and outlet.

At this moment, the electric current values that are applied in order to control the opening areas of the first and second electric proportional control valves (55, 56, 57, 58, 59, 60, 61, 62) depending on the operation amounts of the swing operation lever (50) and the working device operation lever (51) are calculated using the table of the electric current values which are directly proportional to the opening areas of the first and second electric, proportional control valves (55, 56, 57, 58, 59, 60, 61, 62).

Therefore, depending on the working condition or the driver's request during the combined operations of the swing operation lever (50) and the working device operation lever (51), the priority in driving the swing motor (53) and the hydraulic cylinder (54) for the working device can be readily changed.

Although the present invention has been described with reference to the preferred embodiment in the attached figures, it is to be understood that various equivalent modifications and variations of the embodiments can be made by a person having an ordinary skill in the art without departing from the spirit and scope of the present invention as recited in the claims.

INDUSTRIAL APPLICABILITY

According to the present invention having the above-described configuration, the driving sequence of the swing motor for rotating the upper swing body of the excavator and the boom cylinder for driving the working device such as boom can be freely changed.

What is claimed is:

1. A drive control method of hydraulic actuator for construction machine, including an electronic swing operation lever; an electronic working device operation lever; a variable displacement hydraulic pump; a swing motor and a hydraulic cylinder that is driven by hydraulic fluid of the hydraulic pump; first electric proportional control valves at an inlet line and an outlet line of the swing motor for supplying and discharging the hydraulic fluid of the hydraulic pump, respectively; second electric proportional control valves at an inlet line and an outlet line of the hydraulic cylinder for supplying and discharging the hydraulic fluid of the hydraulic pump, respectively; and a controller to which operation signals are inputted by operating the swing operation lever and the working device operation lever, the method comprising:

judging whether or not the swing operation lever and the working device operation lever are in combined operations;

calculating, by the controller, a required pressure of the hydraulic cylinder corresponding to the operation amount of the swing operation lever;

calculating, by the controller, a required flow rate of the hydraulic cylinder corresponding to the operation amount of the working device operation lever, and a required flow rate of the swing motor corresponding to the operation amount of the swing operation lever;

calculating, by the controller, valve opening areas of the first and second electric proportional control valves at the inlet and outlet lines of the hydraulic cylinder or the swing motor using the required pressure and flow rate of the hydraulic cylinder and the swing motor, respectively; and, calculating, by the controller, electric current values inputted to the first and second electric proportional control valves at the inlet and outlet lines by comparing the valve opening areas of the first and second electric proportional control valves at the inlet and outlet lines with a predetermined data or a value of data table, respectively;

wherein the valve opening areas are given as follows;

the valve opening area of the first electric proportional control valve at the inlet of the swing motor=the required flow rate of swing motor/square root of the required pressure of swing motor;

the valve opening area of the first electric proportional control valve at the outlet of the swing motor=the required flow rate of swing motor/square root of [the required pressure of swing motor−the hydraulic fluid pressure drained from the swing motor];

the valve opening area of the second electric proportional control valve at the inlet of the hydraulic cylinder for the working device=the required flow rate of hydraulic cylinder for the working device/square root of the required pressure of hydraulic cylinder for the working device; and the valve opening area of the second electric proportional control valve at the outlet of the hydraulic cylinder for the working device=the required flow rate of hydraulic cylinder for the working device/square root of [the required pressure of hydraulic cylinder for the working device−the hydraulic fluid pressure drained from the hydraulic cylinder], the method further comprising inputting the electric current values into the first and second electric proportional control valves at the inlet and outlet lines to control the valve opening areas of the first and second electric proportional control valves.

2. The drive control method of claim 1, wherein the hydraulic cylinder for the working device is one of the cylinders including boom cylinder, arm cylinder and bucket cylinder.

3. The drive control method of claim 1, wherein the electric current values that are inputted to the first and second electric proportional control valves at the inlet line and the outlet line are calculated using a table of the electric current values which are directly proportional to the valve opening areas of the first and second electric proportional control valves.

4. The drive control method of claim 1, wherein the required pressure of the hydraulic cylinder for the working device corresponding to the operation amount of the swing operation lever is calculated by a table representing boom pressure, arm pressure, and bucket pressure versus the operation amount of the swing operation lever.

* * * * *